United States Patent [19]

Maroy et al.

[11] Patent Number: 5,013,368

[45] Date of Patent: May 7, 1991

[54] METHOD AND DEVICE FOR CLEANING A TUBE IN WHICH A FLUID-CIRCULATES, AND THEIR USE IN HEAT-EXCHANGER TUBES

[75] Inventors: Pierre Maroy, Versailles; Thierry Patureaux, Montivilliers; David Freychet; Roben Loutaty, both of Le Havre, all of France

[73] Assignee: Compagnie de Raffinage et de Distribution Total France, Levallois-Perret, France

[21] Appl. No.: 439,088

[22] Filed: Nov. 20, 1989

[30] Foreign Application Priority Data

Nov. 18, 1988 [FR] France ..... 88 14996

[51] Int. Cl.[5] ..... B08B 9/02

[52] U.S. Cl. ..... 134/22.11; 165/94; 165/95; 15/104.05; 138/38

[58] Field of Search ..... 165/94, 95; 15/104.05; 138/38; 134/22.11

[56] References Cited

U.S. PATENT DOCUMENTS

| | | | |
|---|---|---|---|
| 2,117,175 | 5/1938 | Kaster | 165/94 X |
| 2,943,845 | 7/1960 | Jaklitsch | 165/94 X |
| 4,174,750 | 11/1979 | Nichols | 165/94 |
| 4,781,245 | 11/1988 | Freychet et al. | 165/94 |
| 4,848,446 | 7/1989 | Freychet et al. . | |
| 4,858,682 | 8/1989 | Odelstam | 165/84 |

FOREIGN PATENT DOCUMENTS

| | | |
|---|---|---|
| 282406 | 9/1988 | European Pat. Off. . |
| 1508224 | 1/1968 | France . |
| 2430580 | 2/1980 | France . |

*Primary Examiner*—Martin P. Schwadron
*Assistant Examiner*—Allen J. Flanigan
*Attorney, Agent, or Firm*—A. Thomas Safford

[57] ABSTRACT

The invention relates to a method for the continuous cleaning of the inside of a tube in which a fluid circulates, in which method there is continuously driven in rotation within the tube by the fluid a movable element, one end of which is fastened to one end of the tube through a mechanical linkage permitting it to rotate freely on itself about the axis of the tube. In accordance with the invention, the movable element comprises at least one sharp edge designed to scrape the inner surface of the tube, this edge being disposed so that during the rotation of the movable element it is, along every cross section of the tube, the portion of the movable element farthest removed from the axis of the tube.

17 Claims, 2 Drawing Sheets

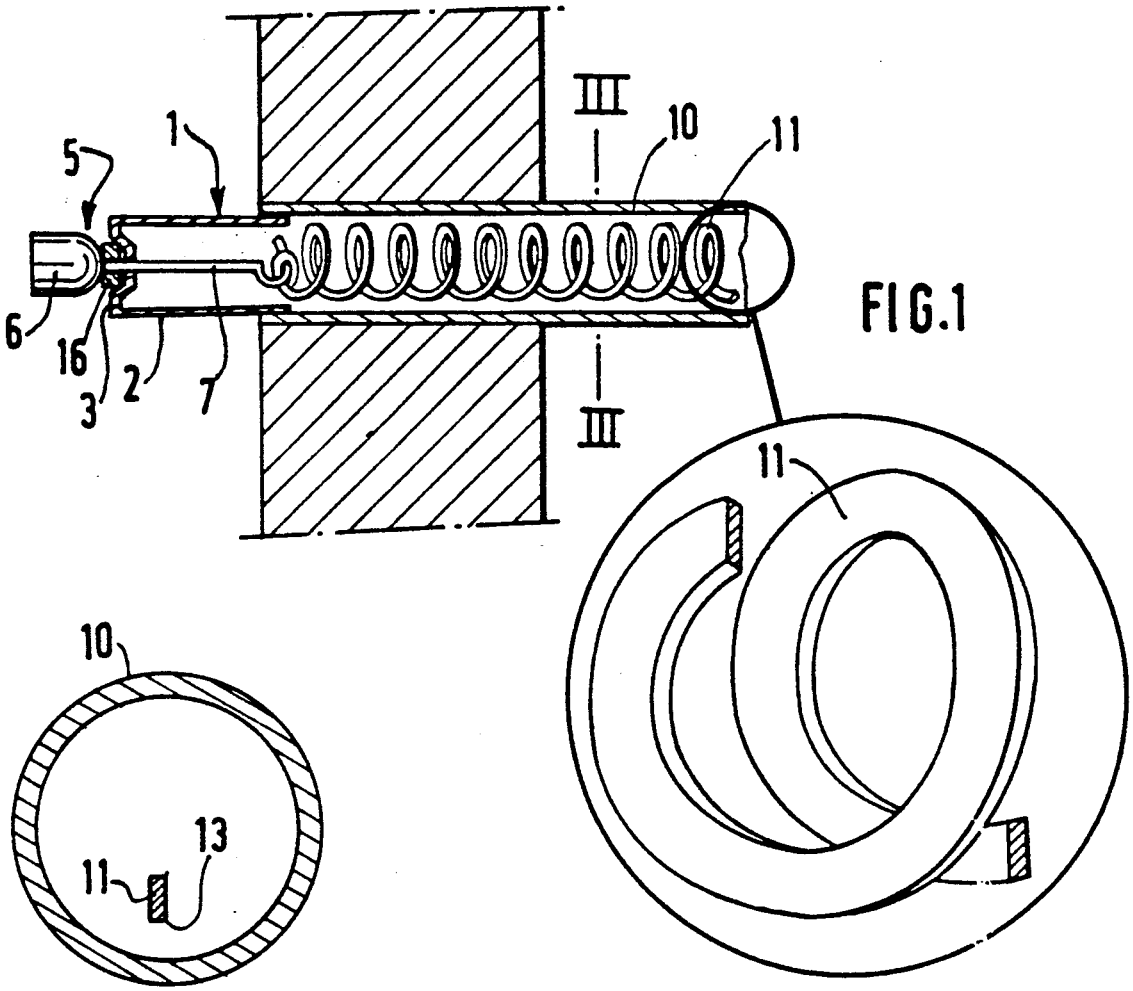
FIG.1
FIG. 3
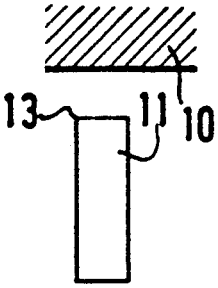
FIG.4
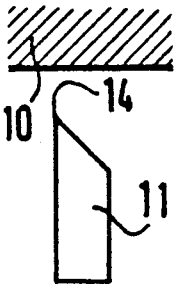
FIG.5
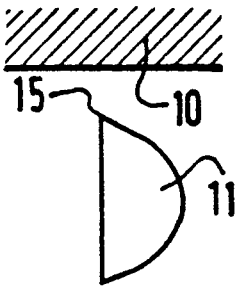
FIG.6

METHOD AND DEVICE FOR CLEANING A TUBE IN WHICH A FLUID-CIRCULATES, AND THEIR USE IN HEAT-EXCHANGER TUBES

The present invention relates to a method and a device for cleaning a tube in which a fluid circulates. It further relates to the use of this method and device in heat-exchanger tubes.

It is known that matter in suspension and matter dissolved in the fluids, particularly calcium carbonate in an aqueous solution, or the coke being formed in hydrocarbons by thermal cracking, have a tendency to deposit on the inner walls of the tubes through which the fluid flows. This is the case especially with the tubes of heat exchangers, whose efficiency falls off very rapidly unless their fouling is slowed down or overcome.

These tubes may, of course, be cleaned periodically, but this makes it necessary to take the heat exchanger out of service, disassemble at least some of its components, and reassemble them after the tubes have been cleaned. These are all time-consuming and expensive operations.

Devices of this type that are placed inside heat-exchanger tubes are well known in the prior art. One patent that may be recalled is German Patent No. 457,572, issued on Mar. 1, 1928, to Paul Cimbolek, which describes a movable element of the metal coil-spring type that is held by a mechanical linkage which permits it to rotate.

This is why it is preferred in practice to locate in the interior of these tubes movable elements of helical shape, for example, which are driven in rotation by the fluid and which provide by their motion for the prevention of fouling and/or for the cleaning of the tubes as well as for improved heat transfer.

In an earlier French Patent application, No. 2,569,829, Applicants' Assignee, then doing business as Compagnie Francaise de Raffinage, thus proposed a mechanical device intended to be placed inside a heat-exchanger tube for the purpose of preventing its fouling and of improving the heat transfer, this device comprising at least one movable element and at least one system for fastening this movable element, and characterized in that the movable element is nondeformable and is of such structure that it can be rotated continually by the fluid circulating in the heat-exchanger tube, the fastening system comprising a mechanical linkage permitting the movable element to rotate freely on itself about the axis of the heat-exchanger tube.

The movable element of this device may have a helical shape and comprises, for example, a wire coiled into such a shape. Various mechanical linkages permitting the movable element to rotate freely on itself are described in said patent application.

Further devices for maintaining such a movable element in position are described in French Patent application No. 2,612,267, also in the name of Compagnie Francaise de Raffinage, the rights to which are held by the Applicants' Assignee. That patent application relates more particularly to a device for maintaining in position one end of a movable element that is driven in rotation inside a tube by the action of a fluid, characterized in that it comprises, on the one hand, a part forming a bearing, made of one piece from a rigid material capable of elastic deformation and having at least two flanges spaced apart by such a distance that they can be force-fitted into an open end of the tube to bear elastically on its inner wall so as to rigidly unite the part forming a bearing with the tube, and, on the other hand; a pivot mounted rotatably relative to the bearing along the axis of the end of the tube and capable of being joined to the element being driven in rotation.

The systems for cleaning the tubes of heat exchangers equipped with such position-maintaining devices have proved particularly effective in cases where the fluid circulating in the tubes includes liquid hydrocarbons, which give rise to relatively copious but not very hard fouling deposits that do not adhere very tenaciously to the walls of the tube.

However, in many heat exchangers fluids are used which result in the deposition in the interior of the tubes of much harder matter that adheres firmly to their walls. This is true particularly of the most common fluid, water, which gives rise to deposits of scale, made up essentially of calcium carbonates.

Tests run by the Applicants with the known tube-cleaning devices, such as those mentioned above, have shown them to be unfit for use when the fluid circulating in the tube is water loaded with carbonates. In fact, the movable element with which these devices are equipped has a tendency to become immobilized when in contact with scale deposited on the walls and thus completely ceases to be effective. As it is no longer being driven in rotation by the water, the scale continues to deposit on the inner wall of the tube, whose heat-transfer properties then deteriorate rapidly so that the tube has to be removed periodically for cleaning.

The Applicants thus have been prompted to look into the modifications to be made to the devices which were proposed earlier in order to make them suitable for preventing the fouling of heat-exchanger tubes when the fluid circulating in them is scale-forming.

A first aim of the invention therefore is to propose a method and a device which are suitable for preventing the fouling of the tubes of a heat exchanger in which a fluid circulates that is apt to deposit scale or a tenaciously adhering hard material on the inner tube walls, and which thus obviate the necessity of disassembling the bundle of tubes periodically to clean them.

Another aim of the invention is to propose a method and a device of this type which utilize a movable element that is driven in rotation within the tube by the fluid circulating in it, and which are such that the movable element is not liable to become immobilized inside the tube when in contact with scale or another deposit formed on the inner tube walls.

A further aim of the invention is to propose a method and a device of this type which improve the heat transfer.

To this end, the invention has as one embodiment a method for the continuous cleaning of the inside of a tube in which a fluid circulates, in which method there is continuously driven in rotation within the tube by the fluid a movable element one end of which is fastened to one end of the tube through a mechanical linkage permitting it to rotate freely on itself about the axis of the tube, said method being characterized in that the movable element comprises at least one sharp edge designed to scrape the inner surface of the tube, this edge being disposed so that during the rotation of the movable element it is, along every cross section of the tube, the portion of the movable element farthest removed from the axis of the tube.

The invention has also as an embodiment a device for the continuous cleaning of a tube in which a fluid circulates, said device comprising a movable element of such shape that it can be driven in rotation by the fluid, and a mechanical linkage permitting one end of the movable element to be fastened to one end of the tube while allowing it to rotate freely on itself about the axis, said device being characterized in that the movable element comprises at least one sharp edge designed to scrape the inner surface of the tube, this edge being disposed so that during the rotation of the movable element it is, along every cross section of the tube, the portion of the movable element farthest removed from the axis of the tube.

The Applicants have found, in fact, that the continuous scraping of the inner tube wall by the sharp edge or edges of the movable element prevents the deposition of scale or of another hard material on that wall and, in cases where such deposition does occur, removes it from the wall and eliminates it, it being swept away by the fluid. "Sharp edge", as used herein, means a salient angle of the polygonal cross section of the movable element.

As described in the aforesaid patent applications, the movable element of the device advantageously consists of a continuous longitudinal component coiled into a helical shape and, in accordance with the invention, has a cross section comprising at least one edge disposed so that it will scrape the inner surface of the tube. This cross section may be polygonal, for example, triangular, rectangular or trapezoidal, or of another configuration.

One embodiment that is preferred because of its simplicity consists of a thin strip of metal, that is, one having a flat rectangular cross section, coiled into a helical shape. Another embodiment that is preferred because it is commercially available may consist of a metallic half-round, that is, a shape having a semicircular cross section or one forming an arc of a circle, coiled to form a helix.

These embodiments of the invention are not, of course, limitative.

The mechanical linkage of the device may be of a type described in the aforesaid patent applications or of any other type, the systems of French application No. 2,612,267 being preferred.

The Applicants have further found that, as will be apparent from the examples given further on in this specification, the device defined above will not only prevent or reduce deposits on the inner surface of tubes equipped with it but, when these tubes are used in a heat exchanger, will significantly increase the heat transfer because of the motion which it imparts to the fluid circulating in the tubes, and because of the continual renewal of the liquid film on the inner wall across which the heat transfer occurs.

The invention therefore also has as an embodiment the use of the method and device defined above in the tubes of heat exchangers.

Various embodiments of the invention will be described further on by way of example with reference to the accompanying drawings, wherein:

FIG. 1 is a cross-sectional view of a heat-exchanger tube equipped with a cleaning device in accordane with the invention;

FIG. 3 is a sectional view taken along line III—III in FIG. 1;

FIG. 4 is a cross section on a larger scale of the movable element of FIG. 1; and FIGS. 5 and 6 are sectional views similar to FIG. 4 showing variations of the cross sections of the movable element.

Figure 2:
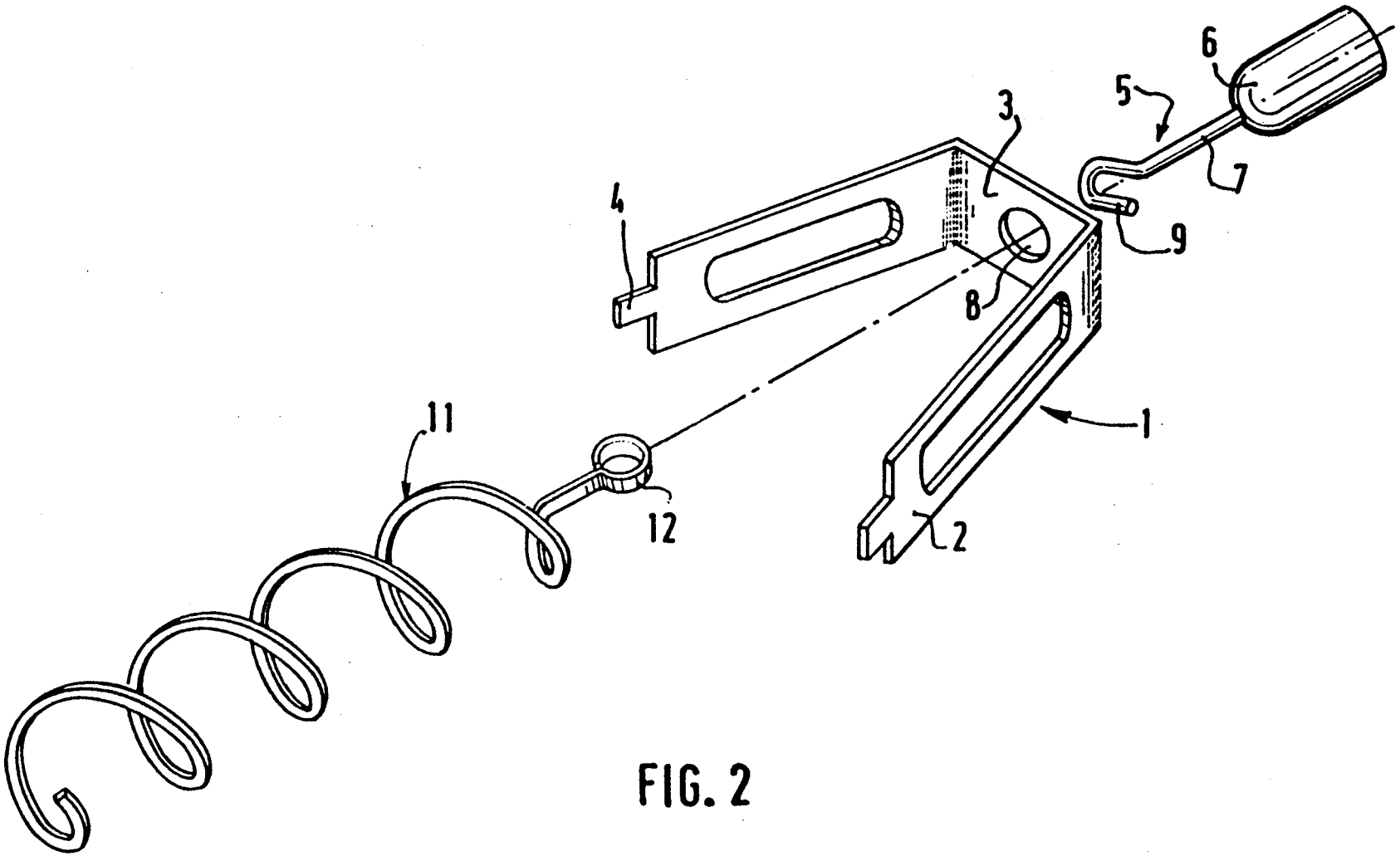
FIG. 2 is a fragmentary exploded perspective view of the cleaning device of FIG. 1.

The device illustrated in FIGS. 1 and 2 comprises, on the one hand, a substantially U-shaped part 1 forming a bearing whose two flanges 2 diverge from the base 3 and are extended by a lug 4 which permits them to be force-fitted into a heat-exchanger tube 10, and, on the other hand, a pivot 5 comprising a head 6 with semi-hemispheric sidewalls and a shank 7 which is inserted in an opening 8 in the base 3 of the bearing 1 and whose end is bent to form a hook 9, and, finally, a movable element 11 of helical shape, accommodated in the tube 10, in which it is driven in rotation by the fluid circulating therein to provide for the continuous cleaning of the inner surface of the tube, a ring-shaped termination 12 of the element 11 being hooked onto the portion of the shank 7 which is bent to form a hook 9.

The part 1 thus forms a bearing for the pivot 5 and the movable element 11, which therefore are able to rotate freely as urged by the fluid circulating in the tube 10. If desired, an antifriction washer 16 may be interposed between the head 6 of the pivot 5 and the base 3 of the bearing 1.

In accordance with the invention, the movable element in this embodiment consists of a thin strip of metal of rectangular cross section (see FIGS. 3 and 4), at least one edge 13 of which is located at all times near the inner surface of the tube 10 to provide for the continuous cleaning of that surface. The flat form of the movable element enables the latter to be readily driven in rotation by the fluid circulating in the tube 10, and its edge 13, which is farthest removed from the axis of the tube, in other words, is closest to the inner wall of the tube, thus is steadily driven in rotation in the immediate vicinity of that wall, providing for the cleaning thereof by scraping and by the turbulence of the fluid.

As is apparent from FIG. 5, the movable element 11 may also have a trapezoidal cross section, with its edge 14 located in proximity to the inner surface of the tube providing for excellent scraping of its wall, and with its aerodynamic form facilitating its being driven in rotation by the liquid circulating in the tube.

Alternatively, the movable element 11 might also have a semicircular cross section, one edge 15 being adjacent to the inner wall of the tube. Such metallic half-rounds are commercially available, and the movable element can therefore be readily fabricated in this shape.

The movable element may, of course, have a shape differing from a helix, for example, one of the shapes described in Patent application No. 2,569,828, provided that it has an edge that is located at all times near the inner surface of the tube which is equipped with the device of the invention.

The invention is of course applicable to the continuous cleaning of tubes in which fluids other than water containing dissolved matter circulate, for example, water containing matter in suspension, such as ferrites, or urea-based liquid mixtures, which may give rise to the formation of extremely hard deposits, as well as hydrocarbons. The invention is also applicable to possibly multiphase mixtures.

The Applicants have not determined exactly how the device of the present invention works but is of the opinion, without this implying any limitation of the scope of its invention, that as the movable element rotates, the inner surface of the tube is being scraped by sectors of the sharp edge or edges, which assures dynamic contact between the movable element and the tube. The newly formed deposit of scale or of a hard material is then being stripped from the wall by this scraping and eliminated by the stream of fluid and therefore cannot spread. The Applicants have found that the device of the invention surprisingly not only prevents or reduces deposits of solid matter in the interior of heat-exchanger tubes but, all things being equal, also results in a significant improvement in heat transfer. This, among other advantages of the method and device of the invention, will become apparent in particular from the examples which follow.

EXAMPLE 1

In a tube of a length of 0.8 meter and an inside diameter of 15 mm, there was used as the movable element of the device of the invention a strip of spring steel having a rectangular cross section of $2.5 \times 1$ mm, coiled to form a uniform spiral in such a way that the small side of its rectangular cross section was disposed radially in the tube.

The outside diameter of the coil was 10 mm, and its pitch, 17 mm.

A system of the type shown in FIG. 2 was used as a fastening means for the strip.

Scale-forming water was circulated in the tube as the fluid at the rate of 0.5 $m^3$/hour, whether the tube was or was not equipped with the cleaning device of the invention.

The following observations were made: After three weeks of operation, the inner wall of the tube which was not equipped with the cleaning device was covered by a layer of scale of an average thickness of approximately 1 mm. In contrast thereto, the inner wall of a tube that was equipped with the cleaning device was, under the same conditions and after the same operating period, covered by a layer of scale whose average thickness was less than 0.2 mm.

EXAMPLE 2

In a tube of a length of 6 meters and an inside diameter of 15 mm, a movable element having the same characteristics as that of Example 1 was placed.

In this tube, a petroleum product (kerosine) was circulated at the rate of 1 meter/second.

Outside of the tube, in a double shell concentric with the tube, a heat-transfer medium was circulated so that the temperature of the kerosine was raised by heat exchange with the heat-transfer medium across the tube wall.

The following results were obtained under the same conditions by measuring the temperature of the kerosine at the inlet ($T_1$) and at the outlet ($T_2$) of the tube:

Tube equipped with the device: $T = T_2 - T_1 = 31.4°$ C.

Tube not so equipped: $T = T_2 - T_1 = 27.8°$ C.

These results represent a 19% increase in the overall heat-transfer coefficient and an increase of about 100% in the internal transfer coefficient.

This specification is based upon a French priority document, France No. 88 14996, filed Nov. 18, 1988, which is incorporated herein by reference.

What is claimed:

1. A method for the continuous cleaning of the inside of a tube in which a fluid circulates, comprising continuously rotating within said tube, a longitudinally-extending movable element shaped to be driven by means of fluid circulating through such tube, said movable element having at least one sharp elongated edge formed of two faces meeting at an angle no greater than an acute angle along an extended length of the movable element, one end of said movable element being fastened to one end of said tube through a mechanical linkage so that said movable element freely rotates about the axis of the tube, during the rotation of the movable element the at least one sharp edge is the portion of the movable element farthest removed from the axis of the tube along every cross section of the tube, and continuously scrapes the inner surface of the tube.

2. A device for the continuous cleaning of a tube in which a fluid circulates, comprising a movable element of such shape that it can be driven in rotation by the fluid and having at least one sharp edge formed of two faces meeting at an angle no greater than an acute angle along an extended length of the movable element, designed to scrape the inner surface of the tube, this edge being disposed so that during the rotation of the movable element it is, along every cross section of the tube, the portion of the movable element farthest removed from the axis of the tube, and a mechanical linkage permitting one end of the movable element to be fastened to one end of the tube while allowing said movable element to rotate freely on itself about the axis of the tube.

3. A method for the continuous cleaning of the inside of a tube in which a fluid circulates, comprising continuously rotating within said tube, a longitudinally-extending movable element shaped to be driven by means of fluid circulating through such tube, said movable element having at least one sharp elongated edge defined by two faces meeting at a substantially constant angle of 90° or less along the effective extent of the moveable element's length and with a sharpness and durability sufficient to prevent excessive buildup of a deposit of at least the hardness of a calcium carbonate scale deposit, one end of said movable element being fastened to one end of said tube through a mechanical linkage so that said movable element freely rotates about the axis of the tube, during the rotation of the movable element the at least one sharp edge is the portion of the movable element farthest removed from the axis of the tube along every cross section of the tube, and continuously scrapes the inner surface of the tube.

4. A device for the continuous cleaning of a tube in which a fluid circulates, comprising a movable element of such shape that it can be driven in rotation by the fluid and having at least one sharp edge designed to scrape the inner surface of the tube and with said edge being defined by two faces meeting at a substantially constant angle of 90° or less along the effective extent of the moveable element's length and with a sharpness and durability sufficient to prevent excessive buildup of a deposit of at least the hardness of a calcium carbonate scale deposit, this edge being disposed so that during the rotation of the movable element it is, along every cross section of the tube, the portion of the movable element farthest removed from the axis of the tube, and a mechanical linkage permitting one end of the movable element to be fastened to one end of the tube while allowing said movable element to rotate freely on itself about the axis of the tube.

5. A device as defined in claim 2, wherein said movable element has a helical shape.

6. A device as defined in claim 3, wherein said movable element has a rectangular cross section.

7. A device as defined in claim 6, wherein said movable element is formed by a strip of metal, coiled to form a helix.

8. A device as defined in claim 7, wherein the strip of metal is flat and is coiled so that one of the small sides of its cross section is directed radially.

9. A device as defined in claim 2, wherein said movable element has a trapezoidal cross section.

10. A device as defined in claim 2, wherein said movable element has a cross section that is semicircular.

11. A device as defined in claim 2, wherein said movable element has a cross section that has the form of an arc of a circle.

12. The method defined in claim 1, wherein said tube is a heat-exchanger tube, and the fluid which circulates therein tends to deposit scale or a tenaciously adhering hard material on the inner surface of said tube.

13. A device as defined in claim 4, wherein said movable element has a rectangular shape and said sharp edge is the leading edge in the sense of rotation of the rectangular shape.

14. A device as defined in claim 4, wherein said movable element has a helical shape.

15. A device as defined in claim 6, wherein said movable element is formed by a strip of metal, coiled to form a spiral.

16. A device as defined in claim 15, wherein the strip of metal is flat and is coiled so that one of the small sides of its cross section is directed radially.

17. The method as defined in claim 3, wherein said tube is a heat-exchanger tube, and the fluid which circulates therein tends to deposit scale or a tenaciously adhering hard material on the inner surface of said tube.

* * * * *